United States Patent [19]

Bolick, Jr. et al.

[11] Patent Number: 5,061,209

[45] Date of Patent: Oct. 29, 1991

[54] WALL PLATE JACK AND CONTACT THEREFOR

[75] Inventors: Virgil T. Bolick, Jr., Asheville; John M. Gentry, Candler, both of N.C.

[73] Assignee: Hubbell Incorporated, Orange, Conn.

[21] Appl. No.: 668,306

[22] Filed: Mar. 13, 1991

[51] Int. Cl.[5] ..... H01R 13/00

[52] U.S. Cl. ..... 439/676

[58] Field of Search ..... 439/660, 676, 682, 692, 439/694

[56] References Cited

U.S. PATENT DOCUMENTS

| | | | |
|---|---|---|---|
| 3,223,960 | 12/1965 | Ruehlmann . | |
| 3,636,500 | 1/1972 | Sedlacek . | |
| 3,670,294 | 6/1972 | Johnson et al. . | |
| 4,026,625 | 5/1977 | Roiko et al. | 439/676 |
| 4,188,086 | 2/1980 | Inouye et al. . | |
| 4,230,391 | 10/1986 | Keglewitsch . | |
| 4,231,628 | 11/1980 | Hughes et al. | 439/676 |
| 4,260,212 | 4/1981 | Ritchie et al. . | |
| 4,288,141 | 9/1981 | Leather . | |
| 4,415,220 | 11/1983 | Kant . | |
| 4,513,499 | 4/1985 | Roldan . | |
| 4,521,961 | 6/1985 | Roeschlein . | |
| 4,585,293 | 4/1986 | Czeshka et al. . | |
| 4,586,778 | 5/1986 | Walter et al. . | |
| 4,606,589 | 8/1986 | Elsbree, Jr. et al. . | |
| 4,607,905 | 8/1986 | Vaden | 339/176 M |
| 4,648,678 | 3/1987 | Archer . | |
| 4,681,392 | 7/1987 | Terita . | |
| 4,698,026 | 12/1987 | Rolf . | |
| 4,701,140 | 10/1987 | Orbanic . | |
| 4,733,465 | 3/1988 | Tanaka . | |
| 4,737,114 | 4/1988 | Yaegashi . | |
| 4,743,081 | 5/1988 | Cobaugh . | |
| 4,746,301 | 5/1988 | Key . | |
| 4,748,841 | 6/1988 | Mezger et al. . | |
| 4,759,721 | 7/1988 | Moore et al. . | |
| 4,762,498 | 8/1988 | Harting et al. . | |
| 4,768,980 | 9/1988 | Collier . | |
| 4,769,907 | 9/1988 | Sebastin . | |
| 4,775,326 | 10/1988 | Lenaerts et al. . | |
| 4,776,807 | 10/1988 | Triner et al. . | |
| 4,778,410 | 10/1988 | Tanaka | 439/676 |
| 4,784,620 | 11/1988 | Tanaka . | |
| 4,793,817 | 12/1988 | Hiesbock . | |
| 4,795,378 | 1/1989 | Tomizu et al. . | |
| 4,821,411 | 4/1989 | Yaegashi . | |
| 4,831,728 | 5/1989 | Barnhouse . | |
| 4,854,900 | 8/1989 | Muhlhoff . | |
| 4,857,019 | 8/1989 | Brubaker et al. . | |
| 4,878,861 | 11/1989 | Kendall et al. . | |
| 4,897,053 | 1/1990 | Verhoeven et al. . | |
| 4,909,754 | 3/1990 | Paradis . | |
| 4,919,622 | 4/1990 | Suffi . | |
| 4,954,103 | 9/1990 | Liebich et al. . | |
| 4,954,104 | 9/1990 | Thomassen . | |

*Primary Examiner*—Joseph H. McGlynn

*Attorney, Agent, or Firm*—Jerry M. Presson; Mark S. Bicks; Alfred N. Goodman

[57] ABSTRACT

An electrical connector for coupling a modular plug connector to a plurality of conductors has a housing with a plug receiving portion and a contact support portion. A plurality of spring contacts, housed within the plug receiving portion, are respectively electrically connected to a plurality of press-fit contacts, housed within the contact support portion. Each of the press-fit contacts are substantially flat with a press-fit tail, a body, and a bifurcated extension aligned colinearly along a longitudinal axis. The press-fit tail is quadrangular, formed with two pairs of indentations, and has substantially equal lengths between midpoints of opposed sides. The press-fit tail is manufactured by punching substantially v-shaped indentations on opposed sides.

22 Claims, 2 Drawing Sheets

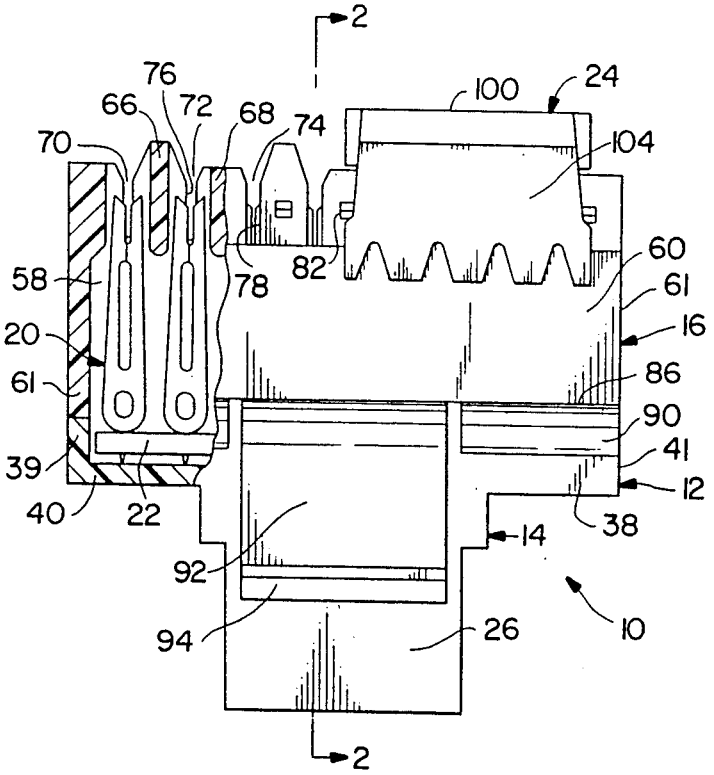
FIG. 1
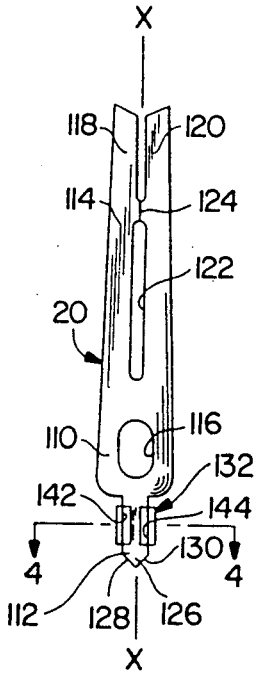
FIG. 3
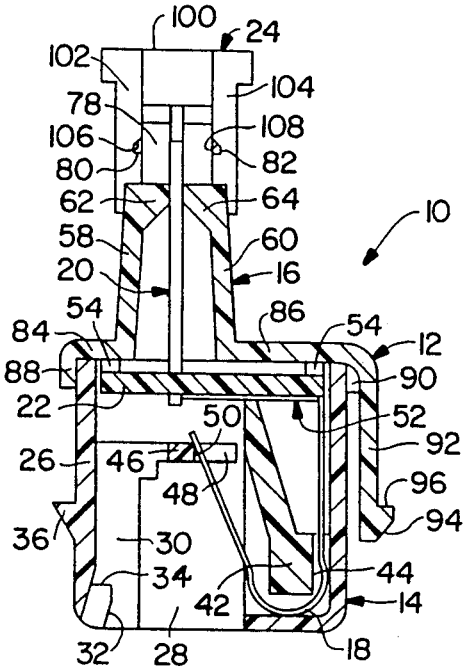
FIG. 2
FIG. 4
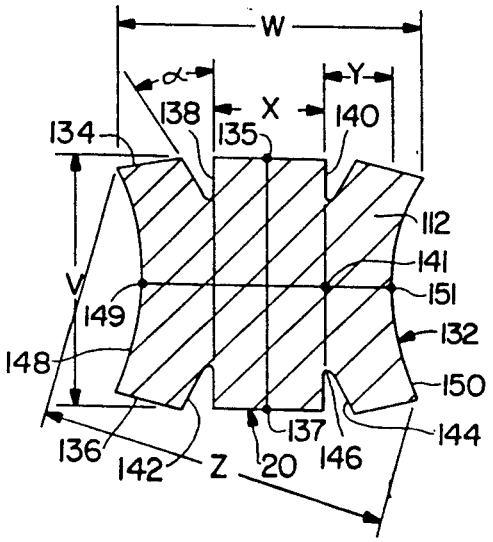

WALL PLATE JACK AND CONTACT THEREFOR

FIELD OF THE INVENTION

The present invention relates to an electrical connector or jack for coupling a modular plug connector to a plurality of conductors. More particularly, the present invention provides a modular housing supporting spring contacts and press-fit contacts, and means for electrically coupling the respective spring and press-fit contacts together. The press-fit contact strips have deformed tails for connection to the electrical coupling means.

BACKGROUND OF THE INVENTION

Electrical connectors typically used for electrically coupling a modular plug connector to a plurality of conductors include a plug receiving housing having spring contacts. The spring contacts are wired to double-ended contact strips retained in a separate housing, which are then connected to the conductors. The double-ended contact strips have bifurcated extensions on opposed ends for retaining wires from the conductors and from the spring contacts.

To reduce the number of parts in the connector and simplify assembly, some connectors are configured with a modular housing joining the plug receiving cavity containing the spring contacts and the housing supporting the contact strips. One such device is disclosed in U.S. Pat. No. 4,648,678 to Archer which discloses a modular plug receiving housing with spring contacts connected to contact strips by a printed circuit board. The contact strips are supported by the housing on only one side and are left exposed prior to connecting the conductor wires with a stuffer member.

Contacts typically retained in a printed circuit board have a press-fit tail or termination pin which is inserted into a through connection hole or the like. Press-fit contacts are typically deformed to accommodate hole tolerances and provide a solderless electrical mechanical connection between the printed circuit and the insert pin. U.S. Pat. No. 4,854,900 to Mauhauf discloses such a deformed press-fit contact pin having a rectangular shape. The shape of the pins or tails are critical because a secure connection in the printed circuit board and an adequate contact surface are mandatory to preserve the integrity of the electric circuit.

Exposed contacts may become damaged during transport and assembly, thus impairing their ability to provide a secure electrical and mechanical connection. Furthermore, contact strips installed in a modular electrical connector must maintain a secure connection in the printed circuit board to avoid replacement of the entire modular electrical connector unit. Accordingly, electrical connectors providing protection to the fragile contacts housed within and maintaining structural integrity within the modular housing are needed in the electrical connector industry.

SUMMARY OF THE INVENTION

Accordingly, an object of the present invention is to provide an electrical connector that provides a secure connection between a modular plug and a plurality of conductors.

Another object of the present invention is to provide an electrical connector that ensures a secure connection between contact strips and a printed circuit.

A further object of the present invention is to provide an electrical connector that has a protective, durable housing to ensure the integrity and safety of the electrical connection.

A yet further object of the present invention is to provide an electrical connector that has a reduced number of parts for less costly manufacture and simpler assembly.

The foregoing objects are basically obtained by an electrical connector, comprising a housing having a plug receiving portion and a contact support portion coupled to the plug receiving portion. A plurality of spring contacts are housed within the plug receiving portion, and a plurality of press-fit contacts are housed within the contact support portion. Each of the press-fit contacts are substantially flat and include a press-fit tail, a body, and a bifurcated extension. The tail, body and bifurcated extension are each aligned colinearly along a single longitudinal axis. Connector means electrically connects the spring contacts to the press-fit contacts.

The foregoing objects are also obtained by a contact for electrical connection between conductors and a printed circuit board, comprising a body portion having a longitudinal axis, a press-fit tail extending colinearly from the body portion along the longitudinal axis, and a bifurcated extension extending colinearly from the body portion along the longitudinal axis in a direction away from the tail. The press-fit tail is formed with two pairs of longitudinal indentations, one pair each on two opposed sides. The tail is quadrangular in cross-section and has substantially equal lengths between midpoints of opposed sides. The extension has two arms defining a slot therebetween.

The foregoing objects are further obtained by a process for manufacturing a contact having a press-fit tail, comprising the steps of providing a substantially flat contact with an elongated tail, shaped as a rectangular prism having a substantially square cross-section; fixing the contact onto a length of tape; profiling the end of the tail by cutting two bevels from the midpoint of the end at about 45°; punching a pair of longitudinal indents into one flat side of the tail in about a 30° V-shape, thereby deforming the side of the tail; and punching a pair of complementary longitudinal indents into the opposed flat side of the tail in about a 30° V-shape, thereby deforming the sides of the tail.

Other objects, advantages, and salient features of the invention will become apparent from the following detailed description which, taken in conjunction with the annex drawings, discloses a preferred embodiment of the invention.

BRIEF DESCRIPTION OF THE DRAWINGS

Referring to the drawings which form a part of this disclosure:

FIG. 1 is a front elevational view in partial section of an electrical connector in accordance with the present invention;

FIG. 2 is a side elevational view in section of the electrical connector taken along line II—II of FIG. 1;

FIG. 3 is a front elevational view of the contact strip of FIGS. 1 and 2;

FIG. 4 is a top plan view in section taken along line IV—IV of FIG. 3;

DETAILED DESCRIPTION OF THE INVENTION

Figure 6A:
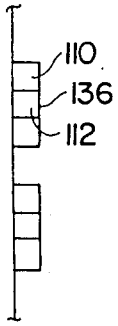
FIGS. 6*a–d* are bottom plan views of the contact strips shown in FIGS. 5*a–d*, respectively.
Figure 5A:
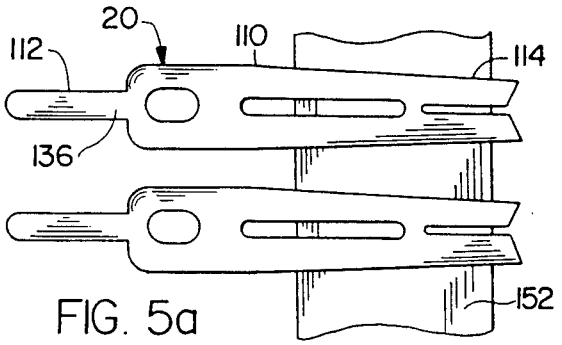
FIGS. 5*a–d* are front elevational views of the contact strip illustrating the process steps for manufacturing of the contact strip according to the present invention.
Figure 6B:
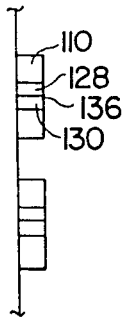
Figure 5B:
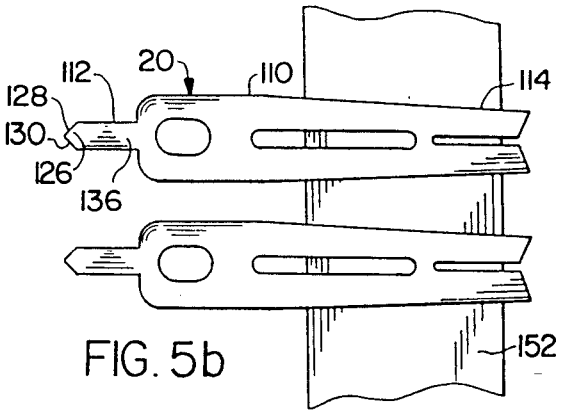
Figure 6C:
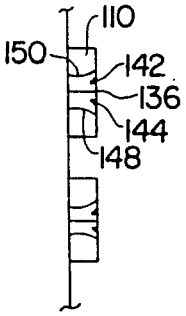
Figure 5C:
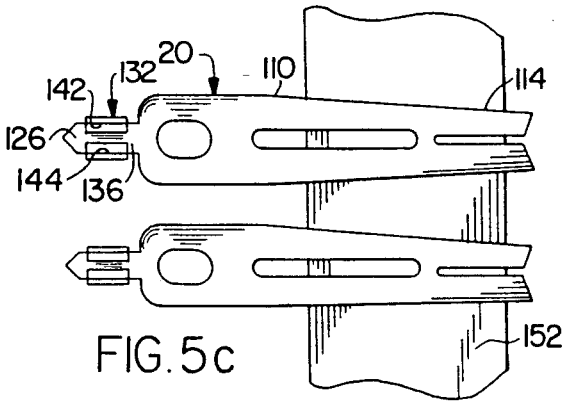
Figure 6D:
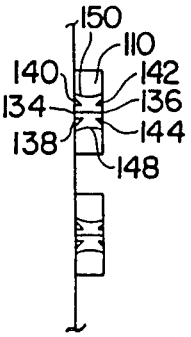
Figure 5D:
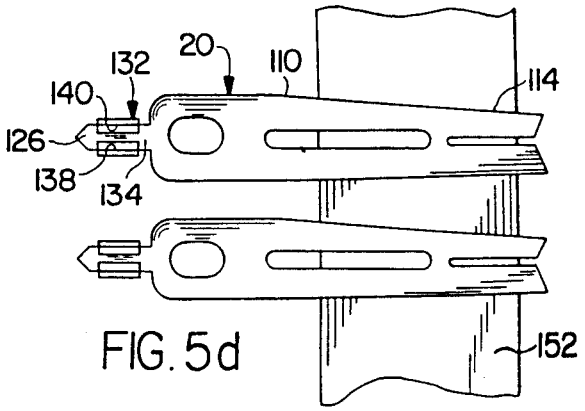

Referring initially to FIGS. 1 and 2, an electrical connector 10 in accordance with the present invention includes a modular jack housing 12 having a plug receiving portion 14 and a contact support portion 16. A plurality of spring contacts 18 are housed within plug receiving portion 14 of housing 12. A plurality of contact strips 20 are housed within contact support portion 16 of housing 12. Spring contacts 18 are connected to contact strips 20 by a printed circuit board 22. A stuffer member 24, such as a Siemens' stuffer, is used in combination with contact support portion 16 to connect electrical conductors or wires to contact strips 20.

HOUSING

Housing 12 is formed of molded dielectric material, preferably a plastic such as Noryl N-190. Plug receiving portion 14 and contact support portion 16 are coupled together by ultrasonic welding or other methods of bonding to form an integral housing.

The plug receiving portion 14 is configured similarly to the jack disclosed in U.S. Pat. No. 4,648,678 to Archer, the subject matter of which is hereby incorporated by reference.

Plug receiving portion 14 is configured with a central hollow, substantially rectangular body 26 defining a plug receiving cavity 28 opening through one end and a pair of opposed, outwardly extending, pan shaped flanges 38 and 40 as shown in FIG. 1. Cavity 28 is shaped to receive an FCC approved electrical connector or plug (not shown). Central body 26 has a recess 30 in one side of cavity 28, a cam surface 32 leading into cavity 28 and an abutment surface 34 within cavity 28 for engaging a standard FCC modular plug. Recess 30 is configured to receive a portion of the modular plug and its latching tab. Cam surface 32 and abutment surface 34 create a stationary latch engaging formation. Cam surface 32 deflects a resilient latch tab on the modular plug as the plug is inserted into cavity 28. Abutment surface 34 releasably retains the plug in cavity 28 by engaging a facing latching surface on the resilient latch tab of the plug. Fixed latch member 36 protrudes from the exterior of central body 26 for engaging a support panel. Pan shaped flanges 38 and 40 open upwardly away from cavity 28 and have upwardly extending lips 39 and 41, respectively, for attachment to plug receiving portion 14.

Within cavity 28 is a contact seat 42 having a row of contact alignment slots 44 for receiving spring contacts 18. Contact seat 42 is received within cavity 28 adjacent to transversely extending partition wall 46. Partition wall 46 extends transversely across central body 26 and includes a plurality of contact alignment slots 48, each of which define an abutment surface 50. Contact alignment slots 44 in contact seat 42 and contact alignment slots 48 in partition wall 46 are formed with the same number and are aligned with each other. In the preferred embodiment, eight spring contacts and complementary slots are provided. As shown in FIG. 2, spring contacts 18 are retained within contact alignment slots 44 and 48 and bear upon abutment surfaces 50 at their free ends.

The other ends of spring contacts 18 are mounted on printed circuit board 22. Printed circuit board 22 is retained within plug receiving portion 14 of housing 12 and extends across central body 26 and into opposed flanges 38 and 40 as shown in FIG. 1. Circuit board 22 has a plurality of individually printed circuits generally indicated as 52 imprinted thereon and corresponding to the number of spring contacts 18. Spring contacts 18 are electrically coupled to the circuits on board 22. The printed circuits terminate in a plurality of conductive lined apertures which individually receive the press-fit contact strips 20. Spacer elements 54 space circuit board 22 from contact support portion 16 of housing 12 as shown in FIG. 2.

Contact support portion 16 includes a hollow body region formed by two opposed side walls 58 and 60. Spaced sidewalls 58 and 60 are joined at their ends by end walls 61 to form a longitudinally extending interior chamber with an open top and an open bottom as shown in FIG. 2. Sidewalls 58 and 60 taper toward each other in the upward direction as illustrated in FIG. 2, and have interior shoulders 62 and 64, respectively, protruding toward each other. Cross webs 66 and 68 as shown in FIG. 1, extend between sidewalls 58 and 60 at spaced intervals along its longitudinal length. Each cross web extends into the interior chamber of contact support portion 16 leaving a large interior central chamber with a plurality of spaced passages 70, 72, and 74, which open upwardly from the central chamber.

Each sidewall 58 and 60 has an upper edge with a plurality of aligned transverse slots. See, for example, slot 76 in sidewall 58 and slot 78 in sidewall 60 as shown in FIG. 1. Each pair of aligned slots is located between the cross webs defining the upwardly open passages. For example, slot 76 crossing passage 72 lies between cross webs 66 and 68. The resulting upper edge of each sidewall, best seen in FIG. 1, is a plurality of upwardly extending fingers alternately tapered and truncated to facilitate connection to stuffer member 24 during assembly.

Located between adjacent slots on each opposed pair of the upwardly extending fingers are a pair of opposed wedge shaped projections 80 and 82.

Extending from the lower edge of sidewalls 58 and 60 are a pair of opposed flanges 84 and 86. Flange 84 has an overhanging lip 88, and flange 86 has an overhanging lip 90. Flange 84 and lip 88 extend the length of sidewall 58 and overhang plug receiving portion 14.

Overhanging lip 90 extends along the length of flange 86 and is interrupted by overhanging latch tab 92. Latch tab 92 is a resilient extension of flange 86 and has a caming surface 94 and shoulder 96 at its end for securement to a support panel. Latch tab 22 and fixed latch 36 are transversely aligned and work in conjunction to secure housing 12 to a support.

Contact support portion 16 is joined to plug receiving portion 14 at the sides by flanges 84 and 86 running longitudinally and at the ends by lips 39 and 41. Flange 84 and lip 88 are secured to the side edges of flanges 38 and 40 and the upper edge of rectangular body 26 of plug receiving portion 14. Lip 90 is secured to the opposite side edges of flanges 38 and 40 of plug receiving portion 14. As discussed, the housing is integrally joined by ultrasonic welding or other methods of bonding plastic.

PRESS-FIT CONTACT STRIP

Contact strip 20 is a flat, metal, resilient strip of electrically conductive material having a body 110, a press-fit tail or pin 112, and a bifurcated extension 114, shown in detail in FIG. 3. The tail 112, body 110 and extension 114 are aligned colinearly along a single longitudinal axis x—x. Press-fit contact 20 is preferably formed of beryllium-copper, 30 μ-inch hard gold plate.

Body 110 has a central aperture 116 which is elliptically shaped and also aligned along longitudinal axis x—x.

Extending from body 110 is bifurcated extension 114 having a pair of parallel longitudinally extending arms 118 and 120. Arms 118 and 120 are angled toward each other on their exterior sides and are spaced from each other on their interior sides to define a slot 122 therebetween. The slot 122 has a constricted portion 124 in which arms 118 and 120 contact. The ends of arms 118 and 120 are pointed and bevelled inwardly from their outer edge towards the longitudinal axis x—x.

Press-fit tail 112 extends from body portion 110 as an elongated pin having the shape of a rectangular prism with a quadrangular transverse cross section. Tail 112 has a pointed end 126 with bevelled sides 128 and 130 extending from the longitudinal axis x-x toward two opposed outward edges at about 45°, forming a tapered, pointed end 126.

Tail 112 has a deformed midsection 132, shown in cross-section in FIG. 4. Two opposed sides 134 and 136 of tail 112 have a pair of opposed longitudinally extending indentations 138, 140, 142 and 144. Each indentation is substantially the same and is generally V-shaped with a rounded bottom 146.

The two remaining sides 148 and 150 of quadrangular tail 112 are arcuate in the deformed midsection 132, as seen in FIG. 4. The undeformed portions of tail 112, above and below midsection 132, are substantially square in cross section.

In the preferred embodiment, deformed symmetrical midsection 132, as shown in cross section in FIG. 4, has a width v measured from midpoint 135 to midpoint 137 of opposed sides 134 and 136 of about 0.031 inches. The distance between each indentation comprising a pair of indentations, for example between indentation 138 and indentation 140, is represented as x and measures about 0.014±0.002 inches. The distance y from the midpoint 141 of a line extending colinearly between the inner edges of opposed indentations 140 and 144 to the midpoint 151 of arcuate sidewall 150 is about 0.009 inches. The angle α of the V-shaped indentations is about 30° as shown in indentation 138. The full length of the deformed section 132 represented by w is about 0.038 inches. When measured diagonally across the cross section, corner to corner, the distance z is about 0.049 inches. Thus, the central section of deformed tail 112 is rectangular as represented by width v and length x. Also, it is apparent from the above dimensions that the distance between midpoints 149 and 151 of opposed sides 148 and 150 compared to the distance between midpoints 135 and 137 of sides 134 and 136 are substantially equal.

THE PROCESS OF FORMING THE PRESS-FIT CONTACT STRIP

Referring to FIGS. *5a–d* and FIGS. *6a–d*, contact strip 20 is initially provided with an elongated tail 112 as shown in FIGS. *5a* and *6a*. A plurality of contact strips are affixed to a length of tape 152 that holds the contact strips securely in place while the tail is being profiled and deformed. Any suitable means for securing the contact strips while work is in progress may be employed.

Tail 112 is first profiled by cutting two 45° bevels 128 and 130 across the longitudinal axis of the end 126 of contact strip 20, as shown in FIGS. *5b* and *6b*.

Next, a pair of V-shaped indentations are punched into tail 112 on one side. As shown in FIGS. *5c* and *6c*, V-shaped indentations 142 and 144 are punched into side 136 of tail 112 causing partial deformation of section 132. The punching action forces the corners of the punched side to protrude outwardly and deforms the adjacent sides arcuately.

After punching the initial pair of indentations, the opposed pair of indentations, in this case indentations 138 and 140, are punched in the opposite side 134. Again, the corners of side 134 are pushed outwardly and adjacent sides 148 and 150 are deformed arcuately.

STUFFER MEMBER

Stuffer member 24, preferably a Siemens' stuffer, is a U-shaped cap with an elongated web 100 and a pair of spaced parallel walls 102 and 104. A plurality of internal cross members extend from the web between walls 102 and 104 forming separate channels, not shown. Each channel has a pair of facing interior depressions 106 and 108 shown in FIG. 2 for snap-fit engagement with protrusions 80 and 82 on sidewalls 58 and 60. The bottom edge of each wall 102 and 104 is serrated as shown in FIG. 1.

Stuffer member 24 is used in conjunction with contact support portion to connect conductors to the press-fit contact strips 20 as discussed below.

ASSEMBLY AND OPERATION

Assembled, plug receiving portion 14 and contact support portion 16 are integrally joined to form housing 12 as discussed. Spring contacts 18 are retained within contact seat 42 with their free ends bearing on abutment surfaces 50 in cavity 28. Spring contacts are electrically connected to printed circuit board 22 at their other end. Press-fit contact strips 20 are retained in apertures of board 22 at their deformed portions of tails 112 and extend between walls 58 and 60 of contact support portion 16. Slots 122 of contact strips 20 align with slots 76 in sidewalls 58 and 60.

In operation, housing 12 is retained within a support by fixed latch 36 and latch tab 92. A plug or electrical connector is inserted into cavity 28 and retained by abutment surface 34. Spring contacts 18 connect with the inserted plug and form an electric circuit through printed circuit board 22 and contact strips 20. To complete the electric circuit, conductors having insulating sleeves are connected to contact strips 20 by being pushed into slots 122 between extension arms of strips 20 with the aid of stuffer member 24. The conductor wires are placed in slots, such as 70 and 72, between upwardly extending arms of side walls 58 and 60. Stuffer member 24 is pushed down over the fingers, forcing the cross members of stuffer member 24 to press the conductor wires into slots 122 of contact strips 20, and pierce the insulating sleeves of the conductors to create an electrical connection. Protrusions 80 and 82 snap into depressions 106 and 108 to hold stuffer member 24 securely in place.

While one embodiment has been chosen to illustrate the invention, it will be understood by those skilled in the art that various changes and modifications can be made therein without departing from the scope of the invention as defined in the appended claims.

What is claimed is:

1. An electrical connector, comprising:

a housing having a plug receiving portion and a contact support portion coupled to said plug receiving portion;

a plurality of spring contacts housed within said plug receiving portion;

a plurality of press-fit contacts housed within said contact support portion, each of said press-fit contacts being substantially flat along its length and including a press-fit tail, a body, and a bifurcated extension, said tail, said body and said bifurcated extension each aligned colinearly along a single longitudinal axis; and connector means for electrically connecting said spring contacts to said press-fit contacts.

2. An electrical connector according to claim 1, wherein each press-fit contact has a body portion having a longitudinal axis;

a press-fit tail extending colinearly from said body portion along said longitudinal axis and being formed with two pairs of longitudinal indentations, one pair on each of two opposed sides, said tail being quadrangular in cross section and having substantially equal lengths between midpoints of opposed sides; and a bifurcated extension extending colinearly from said body portion along said longitudinal axis in a direction away from said tail, said extension having two arms defining a slot therebetween.

3. An electrical connector according to claim 1, wherein said contact support portion is unitarily formed of molded material.

4. An electrical connector according to claim 1, wherein said connector means is a printed circuit board.

5. An electrical connector according to claim 1, wherein a stuffer member for securing conductors to said press-fit contacts is coupled to said housing, said stuffer being U-shaped and having a web and a pair of spaced walls, said walls having serrated edges, internal cross-members, and internal depressions.

6. An electrical connector according to claim 1, wherein said contact support portion has a hollow body with a pair of opposed side walls enclosing said extensions of said press-fit contacts.

7. An electrical connector according to claim 6, wherein said opposed side walls extend from said body beyond said extensions of said press-fit contacts.

8. An electrical connector according to claim 6, wherein said side walls have slots aligned with the longitudinal axes of said press-fit contacts.

9. An electrical connector according to claim 6, wherein said side walls are joined together by a plurality of cross webs, separating at least a portion of each of said extensions of adjacent press-fit contacts from each other.

10. An electrical connector according to claim 6, wherein said side walls have a plurality of protrusions located between said slots.

11. An electrical connector according to claim 6, wherein said side walls taper toward each other and support each of said press-fit contacts on two sides of said contacts.

12. A contact for electrical connection between a conductor and a printed circuit board, comprising:

a body portion having a longitudinal axis;

a press-fit tail extending colinearly from said body portion along said longitudinal axis and being formed with two pairs of longitudinal indentations, one pair on each of two opposed sides, said tail being quadrangular in cross section and having substantially equal lengths between midpoints of opposed sides; and a bifurcated extension extending colinearly from said body portion along said longitudinal axis in a direction away from said tail, said extension having two arms defining a slot therebetween.

13. A contact according to claim 12, wherein said body has an aperture therein.

14. A contact according to claim 12, wherein said arms are angled toward each other.

15. A contact according to claim 12, wherein said arms have ends, said ends being beveled toward said longitudinal axis in the direction of said body portion.

16. A contact according to claim 12, wherein said slot has a constricted portion where said arms contact.

17. A contact according to claim 12, wherein said tail has an end, said tail tapering on opposed sides toward said end to a line.

18. A contact according to claim 12, wherein said indentations in said tail are substantially V-shaped at about a 30° angle and have a rounded bottom.

19. A contact according to claim 12, wherein said tail has two opposed sides which are arcuate.

20. A contact according to claim 12, wherein the distance between indentations comprising each of said pairs of indentations is less than the distance between midpoints of said opposed sides having said indentations therein.

21. An electrical connector, comprising:

a housing having a plug receiving portion with a cavity and a contact support portion with opposed slotted side walls coupled to said plug receiving portion;

a plurality of spring contacts housed within said plug receiving portion;

a plurality of press-fit contacts housed within said contact support portion between said side walls, each of said press-fit contacts being substantially flat along its length and including a quadrangular prism shaped press-fit tail, a body, and a bifurcated extension aligned colinearly along a longitudinal axis, said tail having two pairs of generally V-shaped indentations, one pair on each of two opposed sides and having substantially equal lengths between midpoints of opposed sides; and connector means for electrically connecting said spring contacts to said press-fit contacts.

22. A process for manufacturing a contact having a press-fit tail, comprising the steps of providing a substantially flat contact with an elongate tail shaped as a rectangular prism having a substantially square cross section;

affixing the contact onto a length of tape;

profiling the end of the tail by cutting two bevels across the longitudinal axis of the end at about 45°;

punching a pair of longitudinal indents into one flat side of the tail in about a 30° V-shaped, thereby partially deforming the sides of the tail; and punching a pair of complementary longitudinal indents into the opposed flat side of the tail in about a 30° V-shape, thereby deforming the sides of the tail.

* * * * *